US008602341B2

(12) United States Patent
Land

(10) Patent No.: US 8,602,341 B2
(45) Date of Patent: Dec. 10, 2013

(54) MULTI-SPOOL ADAPTER

(75) Inventor: James T. Land, Concord Township, OH (US)

(73) Assignee: Lincoln Global, Inc., City of Industry, CA (US)

( * ) Notice: Subject to any disclaimer, the term of this patent is extended or adjusted under 35 U.S.C. 154(b) by 325 days.

(21) Appl. No.: 12/953,978

(22) Filed: Nov. 24, 2010

(65) Prior Publication Data

US 2012/0126050 A1 May 24, 2012

(51) Int. Cl.

| | |
|---|---|
| ***B65H 54/20*** | (2006.01) |
| ***B65H 75/30*** | (2006.01) |
| *B65H 75/14* | (2006.01) |
| *B65H 75/28* | (2006.01) |

(52) U.S. Cl.

USPC ..... 242/118.41; 242/474.8

(58) Field of Classification Search

USPC ..... 242/474.3, 474.8, 530, 530.1, 607, 608, 242/118.41, 378.4, 388.6, 594–594.6

See application file for complete search history.

(56) References Cited

U.S. PATENT DOCUMENTS

| | | | |
|---|---|---|---|
| 1,532,600 | A | 8/1922 | Mossberg |
| 1,561,206 | A | 9/1923 | Bixby |
| 1,801,503 | A | 7/1928 | Hathaway et al. |
| 2,020,243 | A | 12/1930 | Hathaway |
| 2,636,695 | A | 4/1953 | Bixby |
| 2,781,986 | A | 2/1957 | Bixby |
| 3,036,785 | A | 5/1962 | Rossi |
| 3,208,690 | A | 9/1965 | Mire |
| 3,214,114 | A | 10/1965 | Wilson |
| 3,337,145 | A | 8/1967 | Keck |
| 3,994,058 | A | 11/1976 | Sasaki et al. |
| 4,019,543 | A | 4/1977 | Sasaki et al. |
| 4,739,945 | A | 4/1988 | Yokoe |

FOREIGN PATENT DOCUMENTS

| | | |
|---|---|---|
| DE | 38 33 958 | 4/1990 |
| GB | 311944 A | 5/1929 |
| GB | 1 561 206 | 2/1980 |
| JP | 2002 153190 | 5/2002 |
| WO | 2004/093536 | 11/2004 |

OTHER PUBLICATIONS

Definition of "unitary" from Compact Oxford English Dictionary.*
International Search Report/Written Opinion for PCT International Application No. PCT/IB2011/002754.

* cited by examiner

*Primary Examiner* — William E Dondero
(74) *Attorney, Agent, or Firm* — Hahn Loeser & Parks LLP

(57) ABSTRACT

An adapter for simultaneously winding multiple spools and a method for using the same. The adapter includes a body portion having a pair of opposed faces and an outer wall or perimeter. Each of the opposed faces may include a plurality of recesses configured to receive a plurality of pins for interconnecting multiple spools. The plurality of pins may be offset such that it provides for the entry hubs of the multiple spools to align with one another. The adapter further includes at least one depression or indentation on the perimeter for providing access to at least a portion of the spool flange. The depression provides an operator with easy access to insert or apply the finishing end of the welding wire or similar, to the finishing hub of the spools.

23 Claims, 14 Drawing Sheets

MULTI-SPOOL ADAPTER

TECHNICAL FIELD

The present invention pertains to welding wire feed systems, welding wire spools and more particularly to providing a spool adapter having a plurality of offset pins protruding from opposed sides of the adapter body for interconnecting multiple spools on a mounting shaft for simultaneously winding multiple spools of welding wire.

BACKGROUND OF THE INVENTION

Welding systems utilize welding wires of many different sizes for use with welding guns during a welding operation. These welding wires are typically provided on different sized spools by welding wire manufacturers. When preparing spools of welding wires, the winding process begins with an operator first placing a single spool on the mounting spindle of a winding machine followed by locking the spool using a locking mechanism so that the spool remains in the proper orientation during the winding process. Once the spool is locked into its proper orientation, the operator's next step is to place the inserted first end of an often rigid welding wire into an entry hub or aperture in the spool, followed by manually bending the first end of the welding wire so that it hooks to the entry hub and holds the welding wire in place during the winding process. The next step is to start the winding process. Operators often elect to wind one spool at a time because of alignment problems caused when attempting to wind multiple spools. This alignment problem arises when the operator hooks the first end of the welding wire in the first spool, with subsequent rotation of the winding machine's spindle so that it is possible to hook the first end of another welding wire in a second spool. This requires the operator to rotate the spindle causing wire to prematurely wind on the first spool in order to align the entry hub on the second spool. If a third spool is desired, a second rotation is required to align the entry hub on the third spool, thereby causing a second premature winding of wire on the first spool and a first premature winding on the second spool and so on. Having to rotate the spools once welding wire is secured to the entry hub is undesirable, because it leads to an unequal amount of welding wire being wound on each spool once the winding process is complete, that is the first spool will have more wire that the subsequent spools because the starting point is different. Additionally, having multiple spools proximate to one another does not provide space for operator to hook the finishing end of the welding wire to the spool.

It is thus desirable to provide a device that interconnects multiple spools for simultaneous winding, provides an easy method of aligning the entry hubs of the multiple spools, prevents the outer flanges of the multiple spools from bowing during the winding process, and for providing access to the finishing hub once at the end of the winding process is complete.

SUMMARY OF THE INVENTION

In one embodiment, a multi-spool adapter for interconnecting multiple spools comprises a body having at least one bore extending through a thickness of the body, a first face opposite a second face, and a perimeter. The first face includes at least one recess extending at least partially through the thickness of the body and is adapted to receive a first positioning means therein. The second face includes at least one recess extending at least partially through the thickness of the body and is adapted to receive a second positioning means therein. The at least one recess on the second face is positioned axially offset from the at least one recess of the first face. Additionally, the perimeter includes at least one depression for providing access to at least a portion of a spool flange.

In another embodiment, the multi-spool adapter for interconnecting multiple spools comprises a body having opposed side faces and a perimeter. The body includes at least one bore extending through a thickness of the body. The perimeter includes at least one depression for providing access to at least a portion of a spool. Each of the opposed side faces includes at least one positioning means protruding therefrom. Still further, the at least one positioning means on one of the side faces is axially offset from the positioning means on the other opposed side face.

In yet another embodiment, an adapter for interconnecting multiple spools comprises a body having a first side face, a second side face, and a perimeter. The first side face and the second side face include a plurality of pins protruding therefrom. The plurality of pins on the first side face are axially offset from the plurality of pins on the second side face. Also, the perimeter includes a means for accessing at least a portion of a spool flange.

In a further embodiment, a method for winding multiple spools on a spooling machine having a winding shaft comprising the step of providing at least a first spool and a second spool. The first and second spool each include a first bore for receiving the winding shaft, a curvilinear slot adapted to receive at least a portion of a pin therein, and a pair of opposed flanges. Still further, the method comprises the step of providing at least one adapter having a body with at least one bore extending through a thickness of the body, a pair of opposed side faces having at least one pin protruding therefrom, and a perimeter. The at least one pin protruding from one of the opposed side faces is axially offset from the at least one pin protruding from the other side face. Additionally, the perimeter includes at least one depression for providing access to at least a portion of one of the opposed flanges. The method further comprises the step of interconnecting the first spool and the second spool with the adapter. Wherein the at least one pin on each of the opposed side faces is received within the slots of the first and second spool. Still further, the method comprises the step of providing a means for mountably securing the first spool, the second spool, and the adapter on the spooling machine. The method further comprises winding the first spool and second spool simultaneously.

DETAILED DESCRIPTION OF THE INVENTION

Figure 1B:
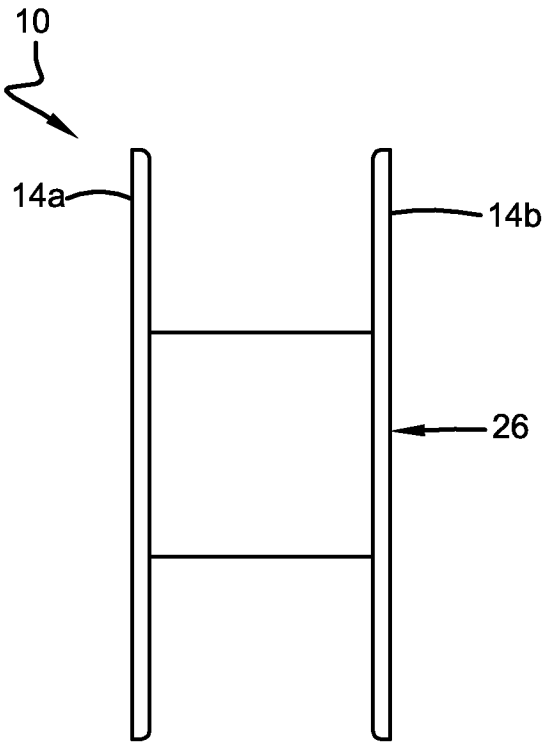
FIG. 1*b* is a view of the welding wire spool of FIG. 1*a* rotated by 90°.

The best mode for carrying out the invention will now be described for the purposes of illustrating the best mode known to the applicant at the time of filing this application. The examples and drawings are illustrative only and not meant to limit the invention as measured by the scope and spirit of the claims.

Spooling or winding machines traditionally include a housing with a motor operatively connected to a reel, spindle or mounting shaft for supporting and driving a spool. The motor is further operatively connected to a controller or user interface for controlling the winding process, which includes controlling the rotational direction of the motor. Winding machines further include brackets or plates used for securing the spools on the mounting shaft. These plates are operatively connected to the winding machine motor and mounting shaft such that the plates rotate in the same direction as the shaft of the motor, clockwise or counterclockwise. Additionally, the plates may include arms protruding therefrom and adapted to fit within the openings in a spool flange for controlling the rotational direction of the spool. The arms mate with the openings such that there is minimal to no space within the opening. In one example, the arms may frictionally fitted into the opening. A second plate may also be used to secure the spool on the mounting shaft. The second plate may have a similar configuration to the first plate (i.e., arms protruding therefrom), or in the alternative, the second plate may have a substantially flat surface corresponding to the side of the spool the spool opposite the first plate. Additionally, the winding machine may include an optional mounting adapter to assist in securing both the plate and the spool on the shaft, or the spool itself when the second plate is not present.

Referring now to the drawings wherein the showings are for purposes of illustrating embodiments of the invention only and not for purposes of limiting the same. The figures show a wire spool adapter of the present invention and its mode of operation.

Figure 1A:
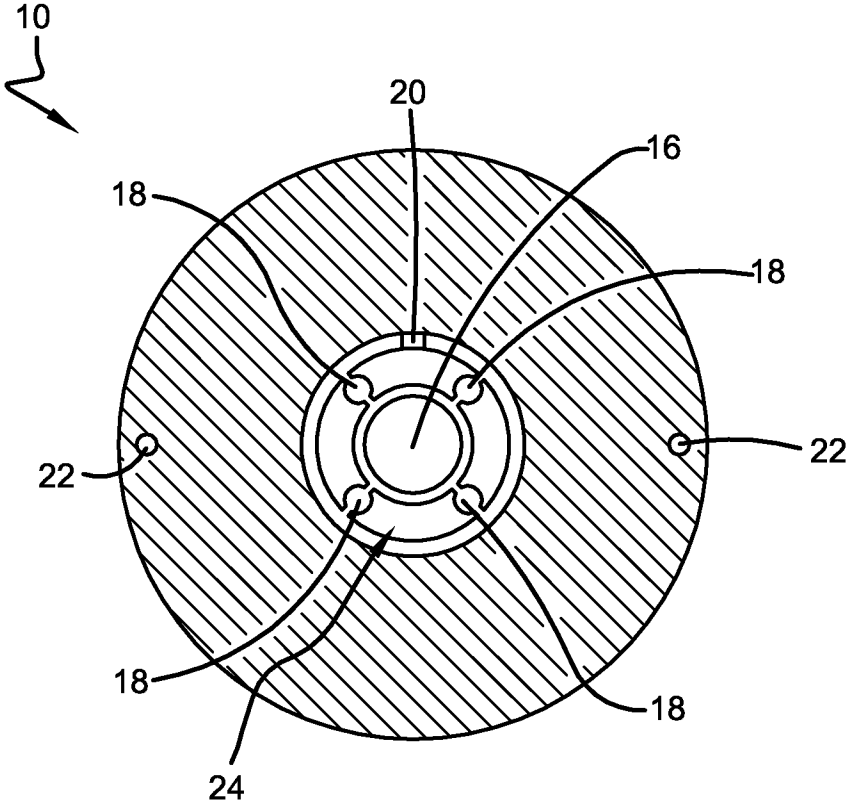
FIG. 1*a* is a side elevational view in partial cross-section of a welding wire spool.
Figure 10:
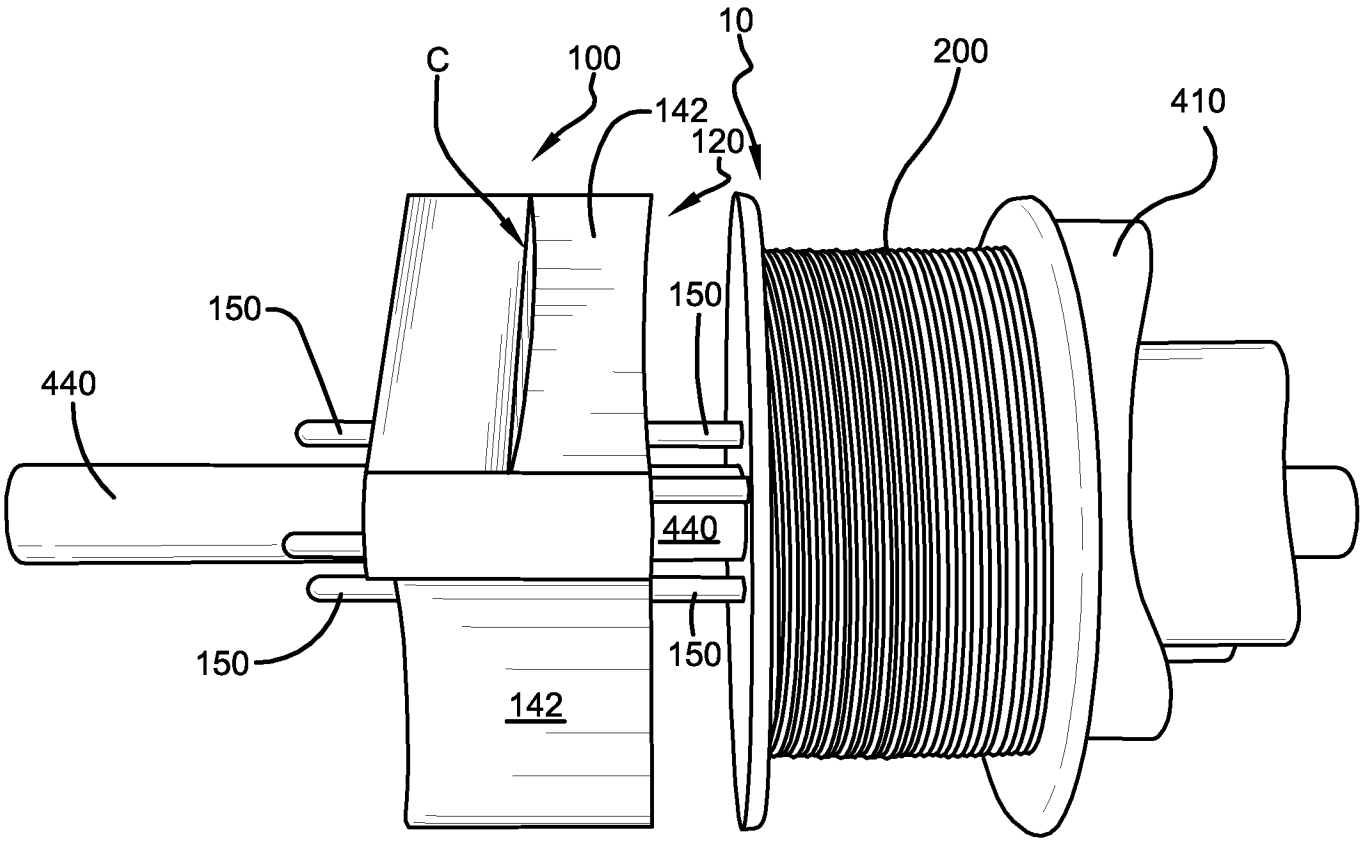
FIG. 10 shows a side elevational view of a welding wire spool and multi-spool adapter on a mounting spindle or shaft in accordance with an embodiment of the present invention.

Generally disclosed within the figures are welding wire spools generally referred to by reference numeral 10. With reference to FIGS. 1*a* and 1*b*, an embodiment of welding wire spool 10 is shown. Welding wire spool 10 includes center portion 12, pair of diametrically opposed flanges 14*a* and 14*b* extending from center portion 12, axially hollowed bore 16 for receiving mounting shaft 440 (shown in FIG. 10), at least one support web 18 and at least one opening or curvilinear axial slot 24. Center portion 12 includes at least one entry hub 20 for receiving a beginning end of welding wire 200 (shown in FIG. 4) to be wound on welding wire spool 10. Welding wire spool 10 may further include at least one tie-off aperture or finishing hub 22 for receiving a finishing end of welding wire 200. In the embodiment shown, welding wire spool 10 includes one pair of finishing hubs 22 on each of opposed flanges 14*a*, 14*b*.

Figure 2:
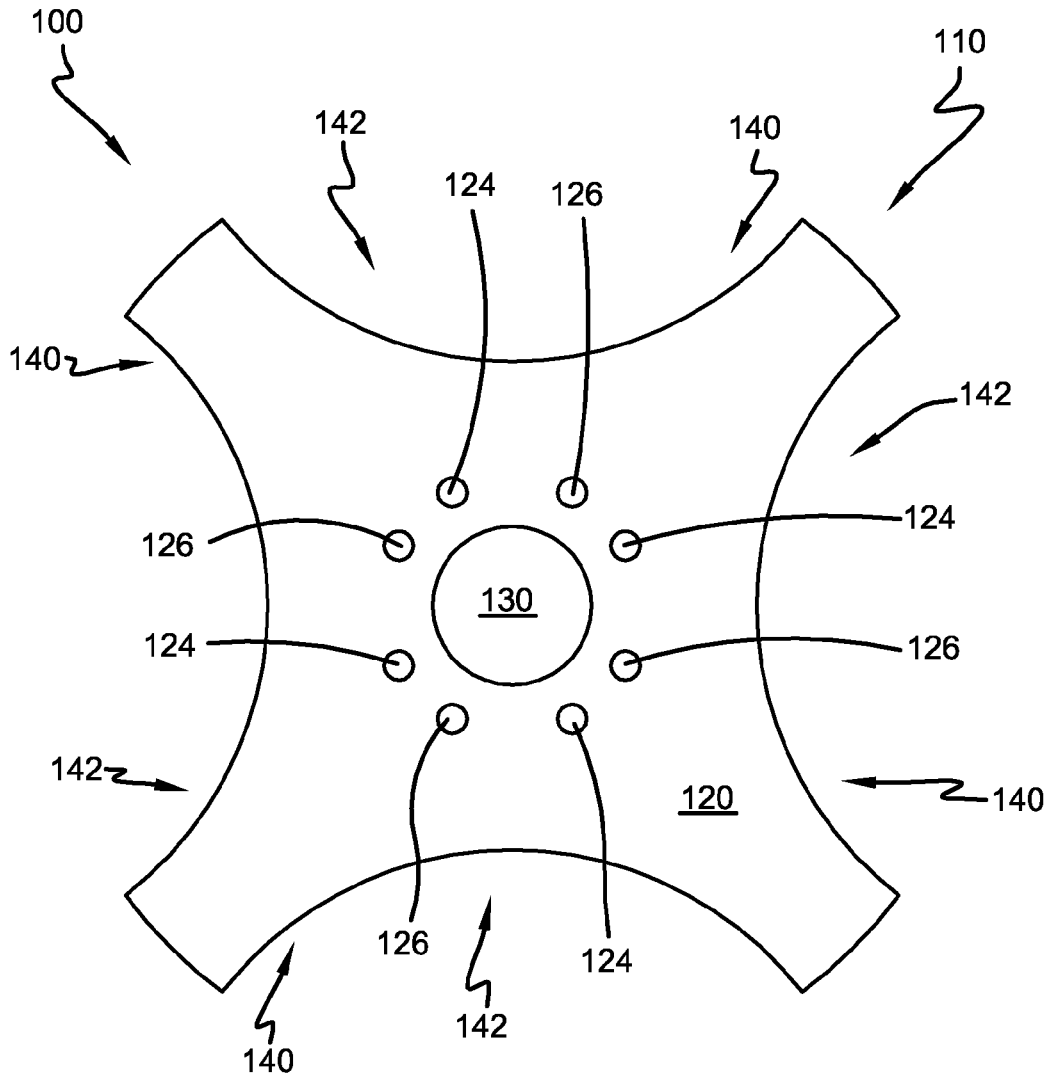
FIG. 2 is a side view of a multi-spool adapter having no pins inserted therein in accordance with an embodiment of the present invention.

As illustrated in FIG. 2, multi-spool adapter 100 according to an embodiment of the present invention is shown. In this embodiment, multi-spool adapter 100 includes body 110, essentially flat first face 120, second diametrically opposed essentially flat face 122 (not shown), at least one mounting bore 130 extending through a thickness of body 110, and outer wall or perimeter 140. Mounting bore 130 may correspond in size and shape with bore 16 of welding wire spool 10. Multi-spool adapter 100 may be constructed from a rigid material such as iron, steel, stainless steel, aluminum, wood (e.g., a medium-density fiberboard (MDF)), a rigid reinforced or cross-linked polymeric material, or any material having the structural integrity to withstand the winding forces generated by winding devices known to a person of ordinary skill in the art. Multi-spool adapter 100 may be any size that prevents opposed flanges 14*a*, 14*b* from bowing during the high winding speeds (e.g., 20-100 meters per second). In one embodiment, the size of multi-spool adapter 100 may approximate the size of the outer diameter of opposed flanges 14*a*, 14*b*, as measured at its longest horizontal distance.

Figure 11:
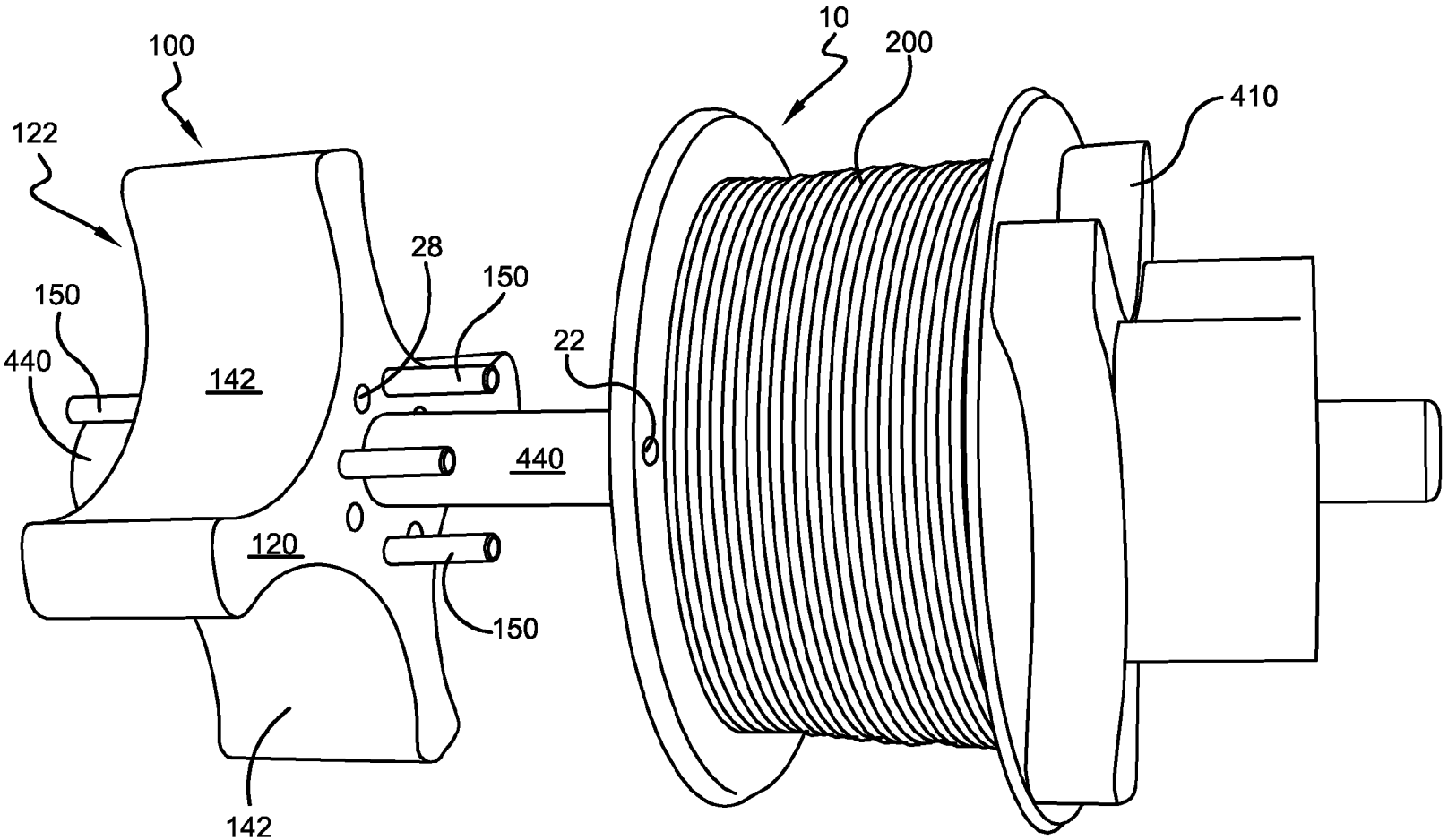
FIG. 11 shows a second perspective view of the welding wire spool and multi-spool adapter on the mounting shaft in accordance with an embodiment of the present invention.
Figure 12B:
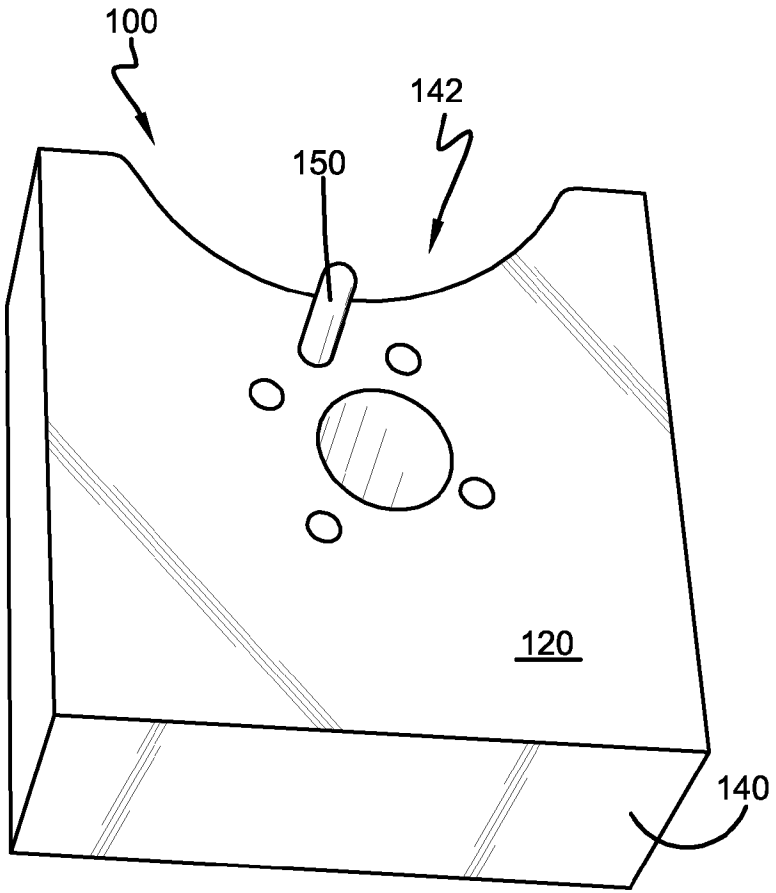
FIG. 12*b* shows a perspective view of a multi-spool adapters in accordance with further embodiment of the present invention.

Perimeter 140 may include at least one depression or indentation 142 (shown in FIG. 12*b*) for providing access to at least a portion of one of opposed flanges 14*a*, 14*b* or both, or more particularly at least one finishing hub 22 of welding wire spool 10. Indentations may be used synonymously herein with the words depression or channel. In the embodiment shown, perimeter 140 includes two pairs of opposed indentations 142, thereby providing access to at least four separate areas, A1, A2, A3, A4 (shown in FIG. 4) of welding wire spool 10. Indentations 142 may be asymmetrically or in a preferred embodiment symmetrically opposed, or equally spaced about perimeter 140, with respect to the center of body 110. In one example, if perimeter 140 includes two indentations 142, first indentation 142 may be positioned about 180 degrees apart from second indentation 142. In an embodiment where perimeter 140 includes four indentations 142, two indentations 142 may be positioned about 90 degrees apart. Indentation 142 may extend from an area proximate to a center C (shown in FIG. 10) of perimeter 140 inwardly toward first face 120 or outwardly toward second face 122. However, indentation 142 may extending from any area proximate to the opposed faces of multi-spool adapter 100 without exceeding the scope of the present invention. In the embodiment shown in FIG. 11, indentation 142 extends from first face 120 to second face 122, i.e., the thickness of body 110, and includes an arcuate profile. In addition to an arcuate profile (better illustrated in FIG. 2), indentation 142 may have a triangular-like shape i.e, have at least intersecting side walls, a polygonal shape, a curvilinear, or any other shape or profile, or combination of the same that is capable of providing access to at least one a portion of opposed flanges 14*a*, 14*b*, or more particularly finishing hub 22 known to a person of ordinary skill in the art.

With continued reference to FIG. 2, first face 120 may include at least one first face recess 124 extending at least partially through the thickness of body 110 and be adapted to receive at least one rod or pin therein. Second face 122 may include at least one second face recess 126 extending at least partially through the thickness of body 110 and adapted to receive at least one rod or pin therein. Alternatively, in another non limiting embodiment, first face recess 124 and second face recess 126 may extend completely through the thickness of body 110, thereby resulting in bores 128 (shown in FIG. 3) extending through the thickness T of body 110. In the embodiment shown in FIG. 2, first face recess 124 is relatively offset from second face recess 126, as further illustrated in FIG. 3. The benefit of having the recesses on opposed faces offset from one another will be explained in further detail herein. As used in this application the term offset means not being collinearly aligned on the same axis. In an embodiment where first face 120 and second face 122 each include one pin 150, it is desirable for welding wire spool 10 to have tightly tolerance dimensions for supporting one pin 150.

Figure 3:
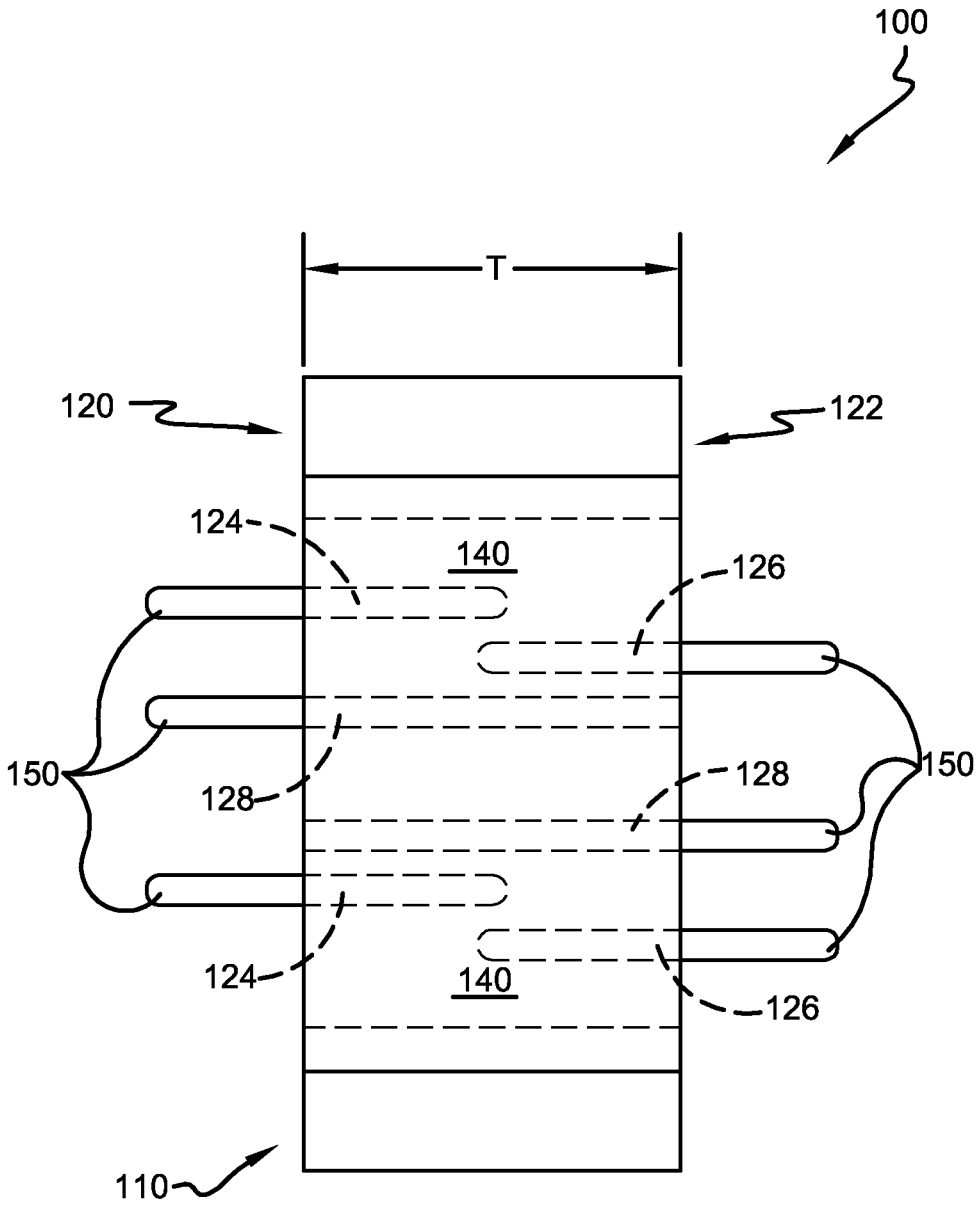
FIG. 3 is a front elevational view of a perimeter of the multi-spool adapter of FIG. 2 illustrating four (4) pins extending from each side of the multi-spool adapter in accordance with an embodiment of the present invention.

With continued reference to FIG. 3, perimeter 140 of multi-spool adapter 100 according to an embodiment of the present invention is shown. In this embodiment, thickness T of body 110 may be any thickness chosen with sound judgment such that access to finishing hub 22 is provided so the operator may tie off or removably secure the finishing end of the welding wire to finishing hub 22. In one embodiment, the thickness of body 110 may be between ½ inch and 3 inches, or more preferably 1 inch, although both larger and smaller dimensions are within the scope of the invention.

First face 120 and second face 122 each may further include at least one rod or pin 150 for mating with corresponding curvilinear axial slots 24 of welding wire spool 10. Pin 150 may circular, or a round shape. As shown in FIGS. 6*a* through 6*f*, positioning means includes various geometric shapes 155 capable of being received within curvilinear axial slots 24. Additionally, various geometric shapes 155 may be similar to Pins 150 in size, strength, construction and function as described herein. Various geometric shape 155 may have a round shape, oval shape, polygonal shape or any shape that is capable of being received within curvilinear axial slots 24 of welding wire spool 10.

Pins 150 may be constructed from a rigid material similar in strength of the material of body 110, or from any material having the structural integrity to withstand the winding forces of the winding device known to a person of ordinary skill in the art. Pins 150 are at least partially secured within first face recess 124 and second face recess 126 such that a portion of pin 150 protrudes in an offset configuration from both faces of multi-spool adapter 100. Pins 150 may be selectively secured in the recesses by a welding process, or by being frictionally fitted into the recesses, or by using an adhesive, or by any other securing means known to a person of ordinary skill in the art. In one embodiment, pins 150 may be partially fitted into the recesses such that a gap may exist between the inserted end of pins 150 and the rearmost area of the recesses. In this embodiment, pins 150 may have a length equal to or less than the thickness T of body 110. The length of pins 150 need only be long enough to impinge welding wire 200 during the winding operation, and drive the adjacent spool or spools. In another embodiment, pins 150 may have a length greater than the thickness T of body 110 such that one end of pin 150 extends through thickness T and is proximate to one face of multi-spool adapter 100, while the other end of pin 150 extends outwardly away from the opposite face of multi-spool adapter 100. In the embodiment shown in FIG. 3, first face 120 and second face 122 each include two recesses 124, 126 extending at least partially through the thickness T. Also shown are two recesses extending fully through the thickness T resulting in bores 128. The recesses may have a similar or different depth so long as the recesses are capable of at least partially receiving pins 150 therein.

Alternatively, in another non-limiting embodiment, pins 150 may be secured to first face 120 and second face 122 without any recesses. In this embodiment, pin 150 are secured to faces 120, 122 in an offset configuration using an adhesive, by a welding process, or any other securing means known to a person of ordinary skill in the art. Additionally, pins 150 may be cast or made integral with body 110.

Figure 12A:
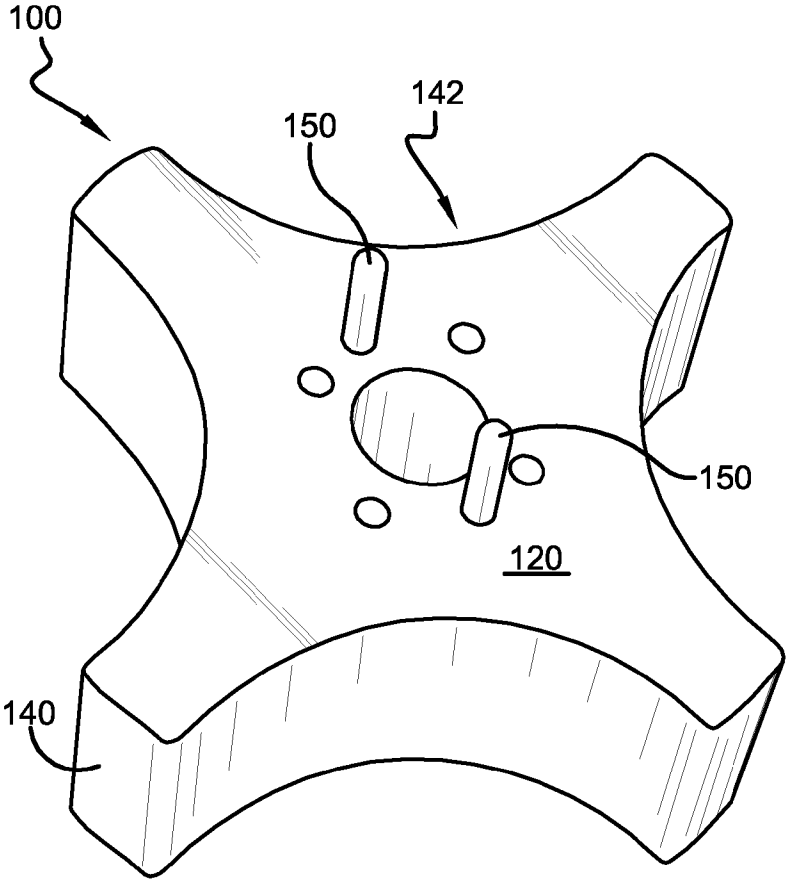
FIG. 12*a* shows a perspective view of the multi-spool adapters in accordance with an embodiment of the present invention.

In its simplest configuration, multi-spool adapter 100 requires at least one pin 150 on first face 120 and at least one corresponding axially offset pin on second face 122. In a further configuration, as shown in FIG. 12*a*, multi-spool adapter 100 includes a pair of pins 150 on first face 120 and a pair of corresponding axially offset pins on second face 122 (not shown), or more preferably two pairs of equally spaced pins 150 on first face 120 and two pairs of corresponding offset pins on second face 122. Each pin 150 of each embodiment described herein may correspond to and mate with openings on welding wire spool 10. In operation, pins 150 may further serve as a means for driving the adjacent spools. Drive means to limit, assist or direct the adjacent spool or spools in a particular direction. For example, an adjacent spool is limited as to the distance it may rotate by the amount of space between pin 150 and support web 18. The friction or force of pin 150 resting upon support web 18 may also direct the adjacent spool in the same rotational direction of mounting shaft 440 (shown in FIG. 9) of winding machine 400 (shown in FIG. 9).

Figure 4A:
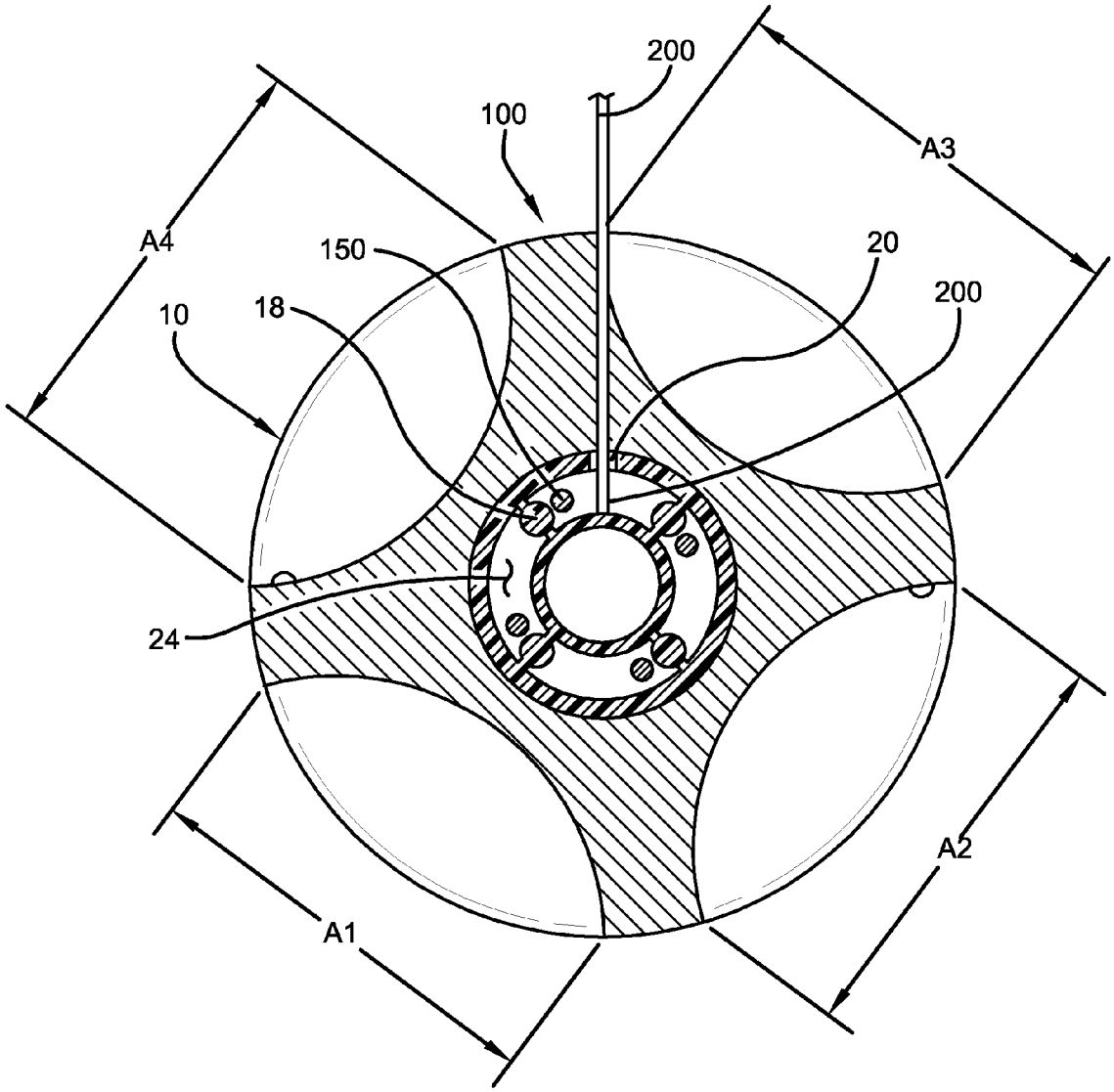
FIG. 4*a* is a partial cross-sectional side elevational view (for illustrative purposes) of a spool having a first end of a welding wire inserted into an entry hub of a spool and having a multi-spool adapter attached thereto in accordance with an embodiment of the present invention.
Figure 4B:
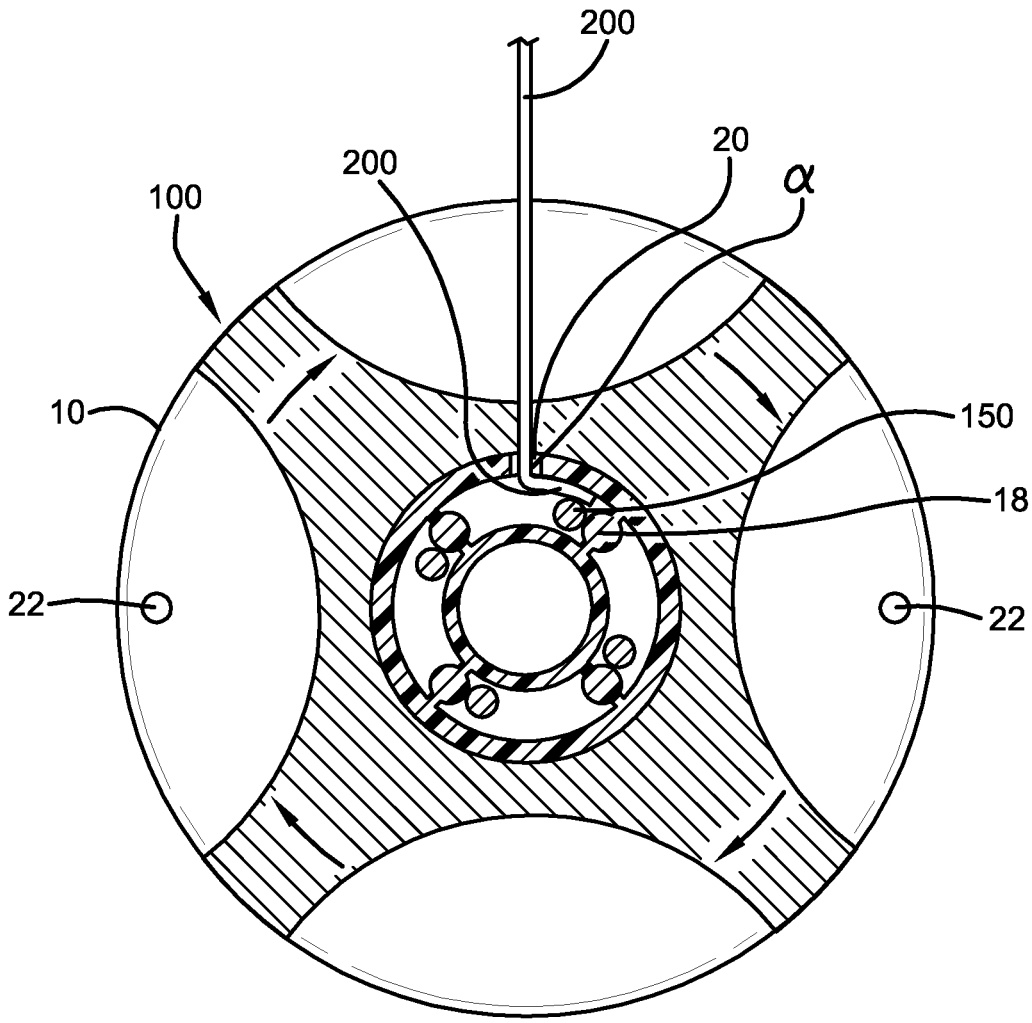
FIG. 4*b* is a partial cross-sectional side elevational view (for illustrative purposes) of the spool of FIG. 2, wherein the multi-spool adapter is rotated clockwise resulting in the first end of the welding wire forming a hook-like shape for securing the welding wire to the spool by impingement of one of the pins against the inserted welding wire in accordance with an embodiment of the present invention.

As illustrated in FIG. 4*a*, welding wire 200 is selectively positioned through entry hub 20 for winding welding wire 200 on welding wire spool 10. Once welding wire 200 is received in entry hub 20, multi-spool adapter 100 is rotated clockwise, or in the alternative counterclockwise, such that pin 150, which is received within curvilinear axial slots 24 of welding wire spool 10, alters welding wire 200 such that an angle $\alpha$ is formed on welding wire 200 securing (e.g., bending) welding wire 200 to welding wire spool 10, as shown in FIG. 4*b*. In yet a further non-limiting embodiment, as shown in FIG. 4*b*, pin 150 may continue to frictionally hold welding wire 200 in its position during the winding process. In the embodiment shown in FIG. 4*b*, a clockwise direction is used to secure welding wire 200 to welding wire spool 10. In this embodiment, the counter-clockwise direction is used to align entry hub 20 on multiple spools.

Figure 5A:
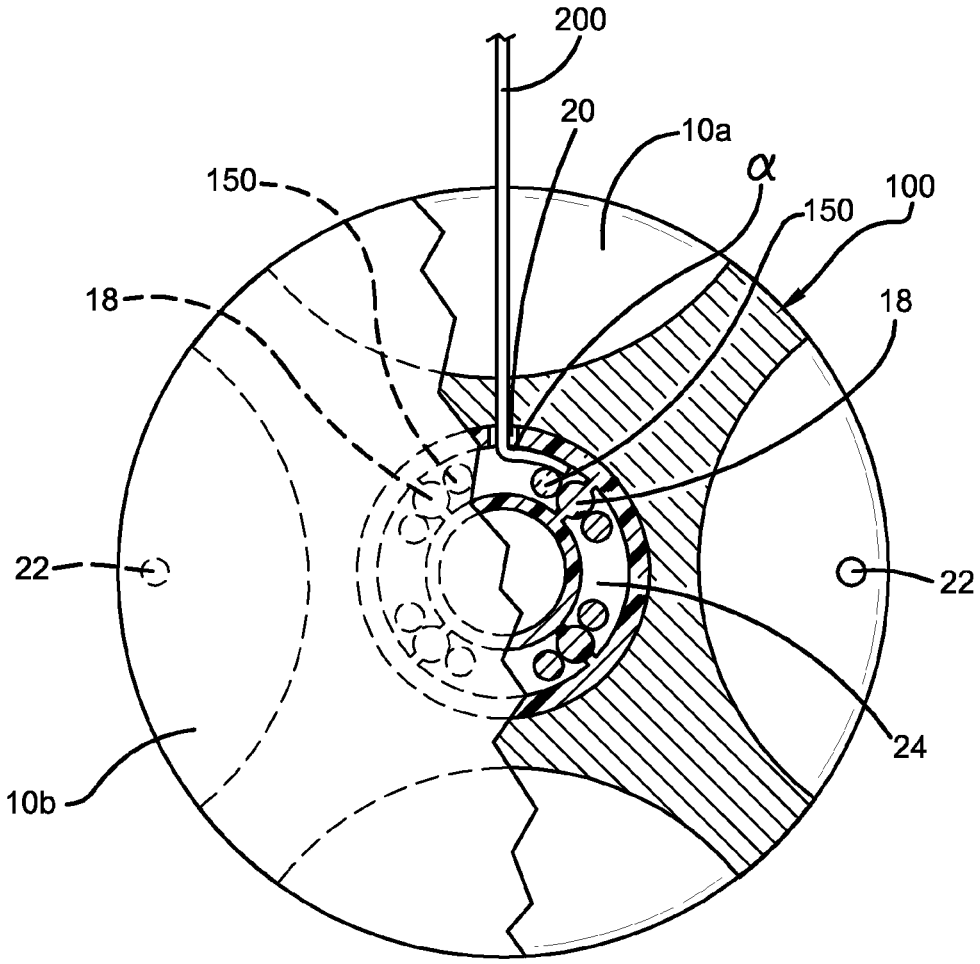
FIG. 5*a* is a partial cross-sectional cut-out side view of a first welding wire spool and a side view of a second welding wire spool interconnected to each other the multi-spool adapter of FIG. 2 in accordance with an embodiment of the present invention.

FIG. 5*a* illustrates a partial cross-sectional cut-out view of a first welding wire spool 10*a* and a side view of a second welding wire spool 10*b* interconnected by multi-spool adapter 100 in accordance with an embodiment of the present invention. FIG. 5*a* better illustrates the relative offset position of pins 150 protruding from first face 120 (not shown) and second face 122 (not shown). The benefit of the offset position of pins 150 and its use in the winding process will now be explained.

When multi-spool adapter 100 interconnects two or more spools, rotating multi-spool adapter 100 in one direction secures welding wire 200 in entry hub 20 of the first welding spool 10*a*, while not interfering with the alignment of welding wire 200 in entry hub 20 of the second welding spool 10*b*. This is accomplished by having pins 150 axially offset and allowing for second welding spool 10*b* to be rotated in a first direction (clockwise or counterclockwise), thus allowing entry hub 20 of second welding wire spool 10*b* to be aligned for receiving welding wire 200, then later rotating multi-spool adapter 100 in a direction for securing welding wire 200 without interfering with or winding additional wire on first welding wire spool 10*a*. Throughout the rotation of the adapter and spools for alignment of entry hub 20, once welding wire 200 is secured, access to at least a portion of flanges 14*a*, 14*b* of the multiple spools, or more particularly, access to finishing hubs 22 of the multiple spools is maintained, as shown in FIG. 5*b*, thereby allowing the finished end of welding wire 200 to be secured to welding wire spool 10.

Figure 5B:
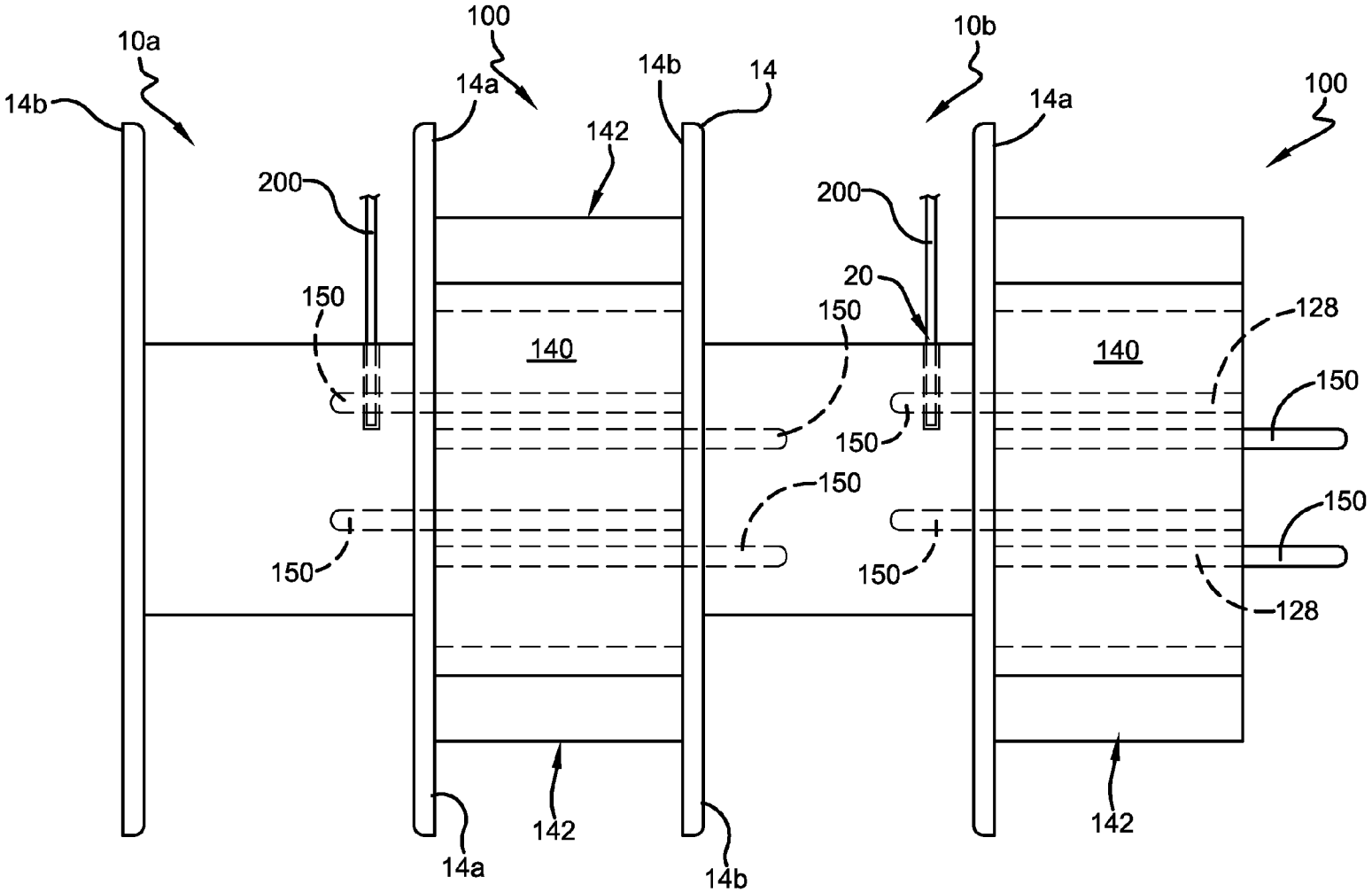
FIG. 5*b* is a view of the multi-spool adapter of FIG. 5*a* rotated by 90°.
Figure 6A:
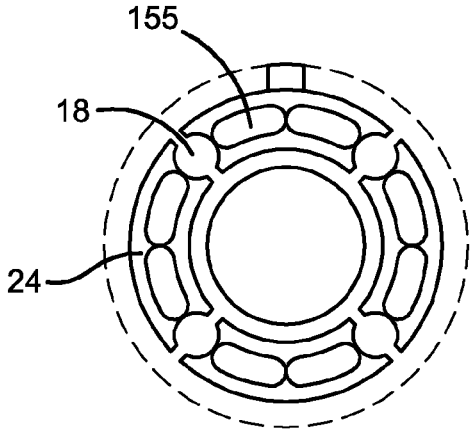
FIGS. 6*a* through 6*f* are a side views of yet a further embodiment of the multi-spool adapter having positioning means of a various configuration.
Figure 6B:
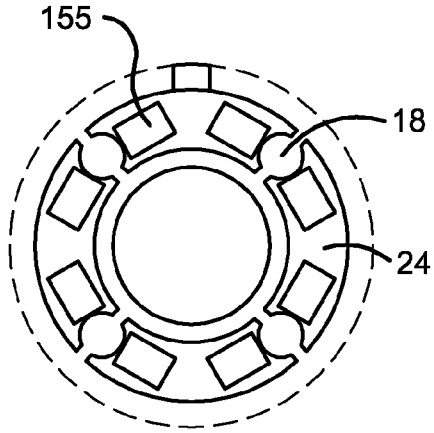
Figure 6C:
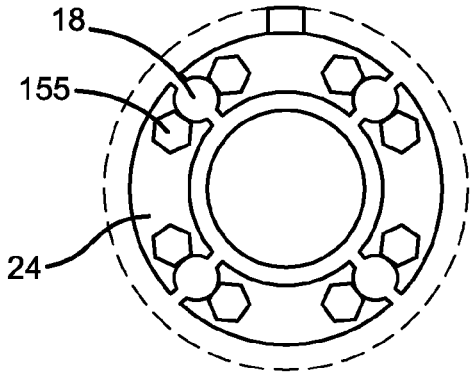
Figure 6D:
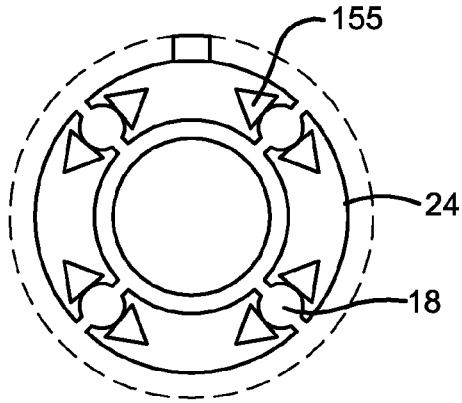
Figure 6E:
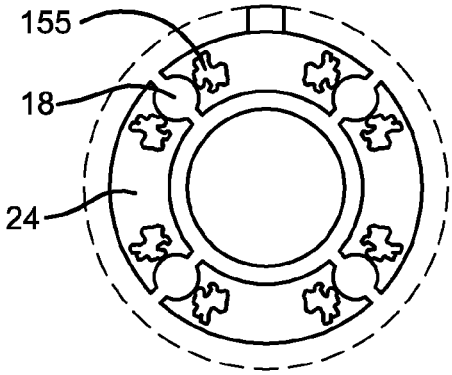
Figure 6F:
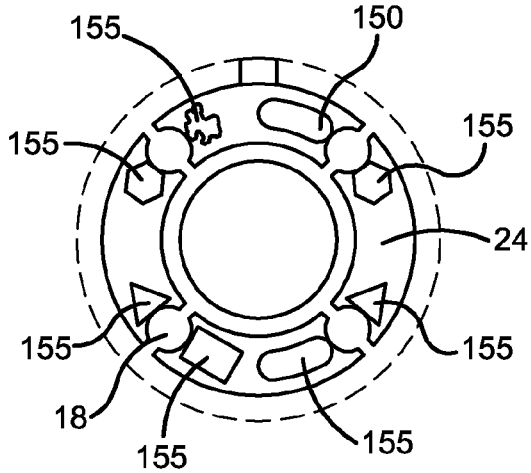
Figure 9:
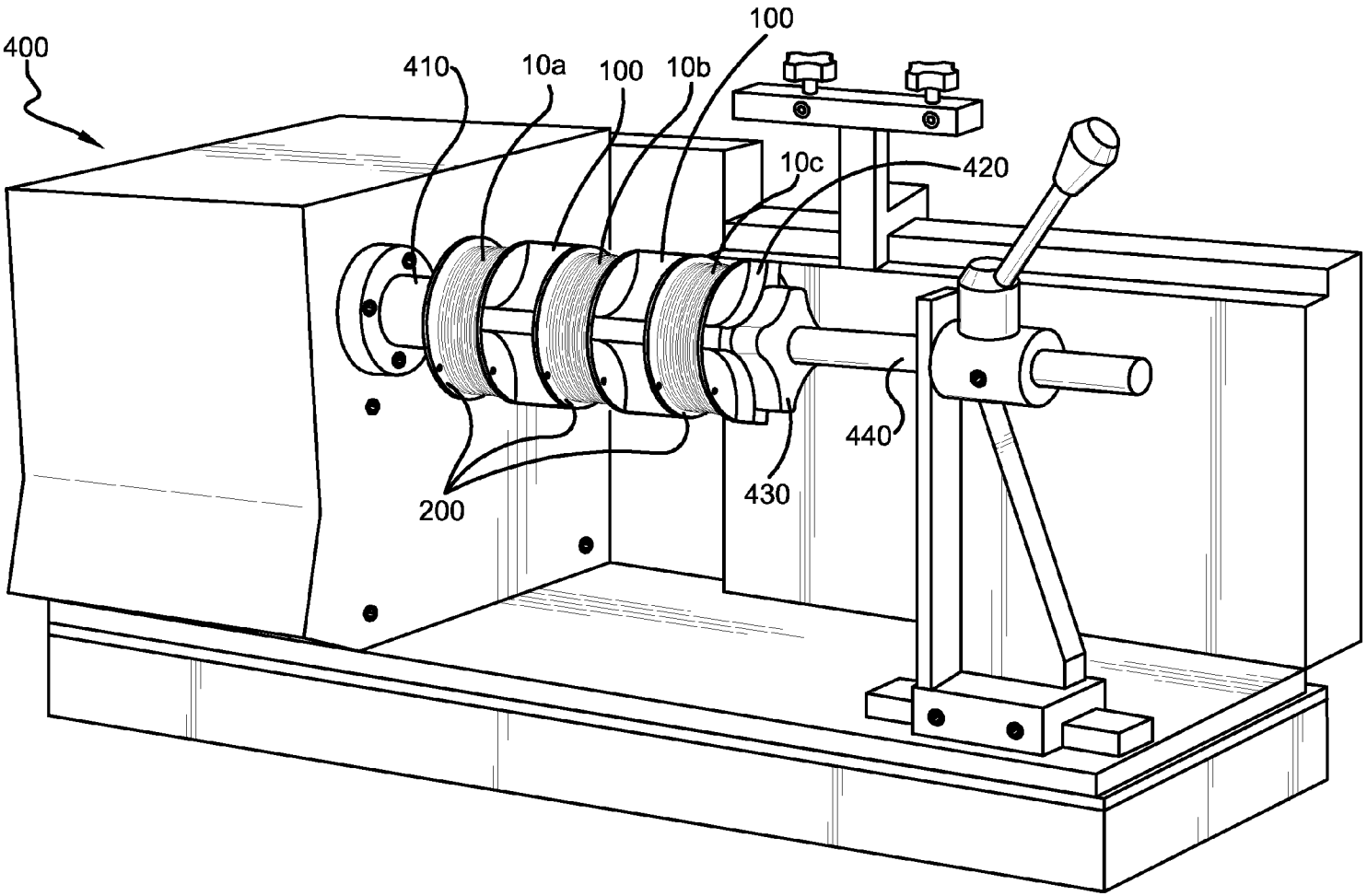
FIG. 9 shows a perspective view of a welding wire machine having a plurality of welding wire spools interconnected the multi-spool adapters in accordance with an embodiment of the present invention.

With continued reference to FIG. 5*b* and now FIG. 9, in operation, for example, when multi-spool adapter 100 interconnects two spools, first welding wire spool 10*a* is mountably secured to first plate 410 of winding machine 400 on mounting shaft 440. First plate 410 typically includes a plurality of arms (not shown) extending from a side of first plate 410 and corresponding to curvilinear axial slots 24 of first welding wire spool 10*a*. The arms may frictionally fit into curvilinear axial slots 24 or fit in such a manner that very little, if any, movement is possible. The arms assist in facilitating the winding process, by driving the spools and adapters in the same direction of winding machine's 400 motor. Once the arms mate with curvilinear axial slots 24 of first welding wire spool 10*a* securing first welding wire spool 10*a* to first plate 410, multi-spool adapter 100 is then mountably secured on mounting shaft 440 by slidably placing Multi-spool adapter 100 on mounting shaft 440 such that pins 150 on first face 120 may be received within curvilinear axial slots 24 of first welding spool 10*a* opposite first plate 410. Pins 150 are received within curvilinear axial slots 24 in a manner that does not interfere with the arms of first plate 410. Next, second welding wire spool 10*b* is slidably placed on mounting shaft 440 in such that pins 150 extending from second face 122 are received within curvilinear axial slots 24 of second welding wire spool 10*b*. At this point, several options are available to the operator. In securing both spools and multi-spool adapter 100, the operator may elect to use an optional mounting adapter 430, a second multi-spool adapter 100, a second plate 420, or any combination of the three, or by any means known to a person of ordinary skill in the art.

In an example where mounting adapter 430 is used, the operator may place second welding wire spool 10*b* on mounting shaft 440 in a direction such that entry hub 20 of second welding wire spool 10*b* is proximate to pins 150 extending from second face 122, such that pins 150 may be used to secure welding wire 200. Next, the operator may insert welding wire 200 into entry hub 20 on first welding wire spool 10*a*, rotate multi-spool adapter 100 in a direction, clockwise or counterclockwise, which secures welding wire 200 to first welding wire spool 10*a*. Next, the operator may insert welding wire 200 into entry hub 20 on second welding wire spool 10*b* and rotate second welding wire spool 10*b* in a direction opposite the initial rotation direction of multi-spool adapter 100, thereby securing welding wire 200 to second welding wire spool 10*b* and aligning entry hub 20 on each of the spools. Thereafter, mounting adapter 430 may be used to frictionally secure first plate 410, welding wire spools 10*a* and 10*b*, and multi-spool adapter 100 on mounting shaft 440 such that there is limited or no lateral movement during the winding process.

In another example, second plate 420 is used by the operator in combination with mounting adapter 430 to frictionally secure first plate 410, welding wire spools 10*a*, 10*b*, and multi-spool adapter 100 on mounting shaft 440. Second plate 420 may have multi-spool adapter 100 integral with a side of second plate 420, or second plate 420 may include arms configured similarly to pins 150 extending from multi-spool adapter 100 for being received within curvilinear axial slots 24 of the welding spool, and being slidably mounted on mounting shaft 440 before mounting adapter 430 is slidably mounted on mounting shaft 440. In an embodiment where second plate 420 is used alone. The arms extending from second plate 420 should be similarly situated as pins 150 on first face 120 so that entry hub 20 on second welding wire spool 10*b* is aligned with entry hub 20 on first welding wire spool 10*a* once both welding wires 200 on each spool are secured. In this instance, rotating second plate 420 in a similar direction to that of multi-spool adapter 100, prior to using mounting adapter 430 to frictionally secure the spools, adapter and plate, will impinge welding wire 200 against the arms extending from second plate 420. This impingement is similar to the impinged welding wire 200 of first welding wire spool 10*a* after multi-spool adapter 100 is rotated. After both entry hubs are aligned, the operator may use a mounting member (not shown) integral with second plate 420 to frictionally secure both plates, spools and multi-spool adapter 100 on mounting shaft 440 such that there is no lateral movement during the winding process.

In yet another example, the operator may use one adapter for each welding wire spool 10. For example, if the operator chooses to wind three (3) spools, he would use three (3) adapters. This embodiment is similar to the previous embodiments, except that in this embodiment a third multi-spool adapter 100 is used for securing welding wire 200 to second welding wire spool 10*b*. When multiple adapters are used in this manner, each multi-spool adapter 100 is preferably rotated in the same direction for impinging welding wire 200 and aligning entry hub 20 on each spool. However, second plate 420 or mounting adapter may still be used to frictionally secure the multiple spools and adapters on mounting shaft 440 such that there is limited or no lateral movement during the winding process.

Figure 7A:
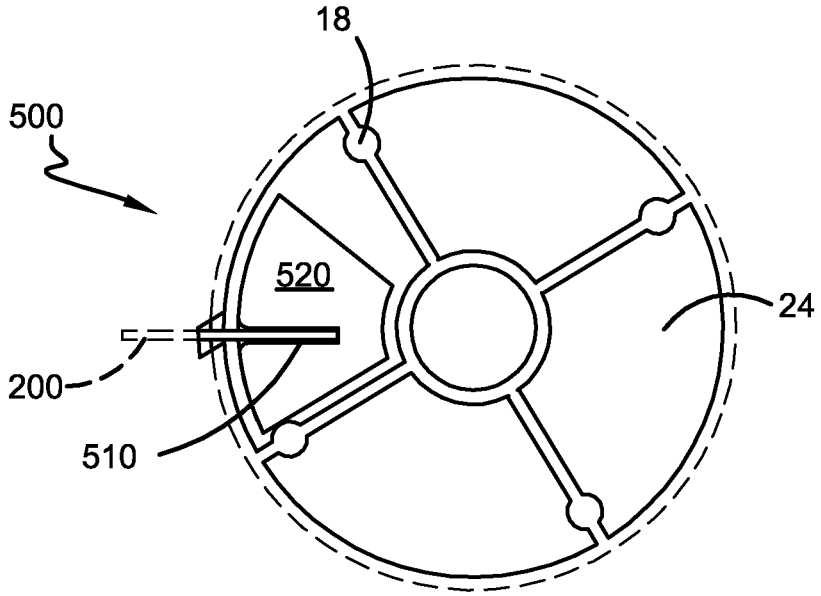
FIGS. 7*a* through 7*b* are side views of a multi-spool adapter in accordance with a further embodiment of the present invention.
Figure 7B:
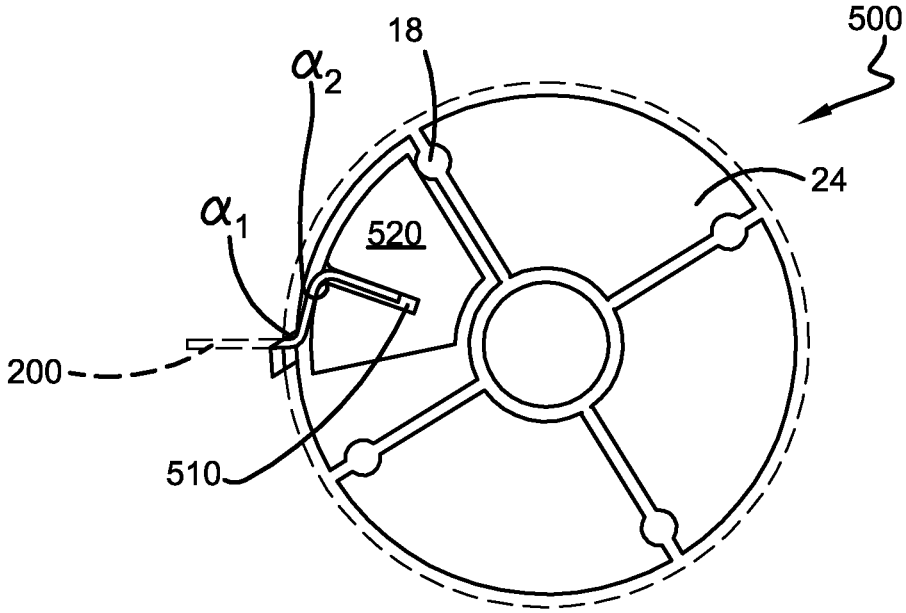

With reference to FIGS. 7*a* and 7*b*, a second configuration of multi-spool adapter 500 is shown having another embodiment of the positioning means as a tab 520. In this embodiment, tab 520 extends from the opposed faces of multi-spool adapter 500. In this embodiment, tab 520 includes slot or recess 510 adapted to receive welding wire 200. When multi-spool adapter 500 is rotated, welding wire 200 is secured (i.e., bent) creating at least two angles $\alpha 1$ and $\alpha 2$ in welding wire 200 prior to beginning the winding process. Tab 520 having recess 510 may also be used in lieu of pin 150 in the above embodiments without exceeding the scope of the present invention.

Tab 520 may be mounted upon multi-spool adapter 500, or received within a recess in multi-spool adapter 500. In another embodiment, tab 520 may be integral with the opposed faces of multi-spool adapter 500 i.e., cast or molded with multi-spool adapter 500. In yet a further embodiment, for creating at least two angles $\alpha 1$ and $\alpha 2$ in welding wire 200, at least a pair of positioning means offset from each other may be used in lieu of tab 520.

Welding wire spool 10 may be any size commonly used for welding wires. For example, manufacturers produce welding wire spools as small as two (2) inches to as large as eighteen (18) inches. Additionally, multi-spool adapter 100 may be used for interconnecting larger spools not used for the welding industry, but for any other commercial industry. For example, multi-spool adapter 100 may be used to wind multiple spools of cable wire (i.e., coaxial, fiber, category 6 Ethernet etc.), or any other material sold on a spool.

Figure 8:
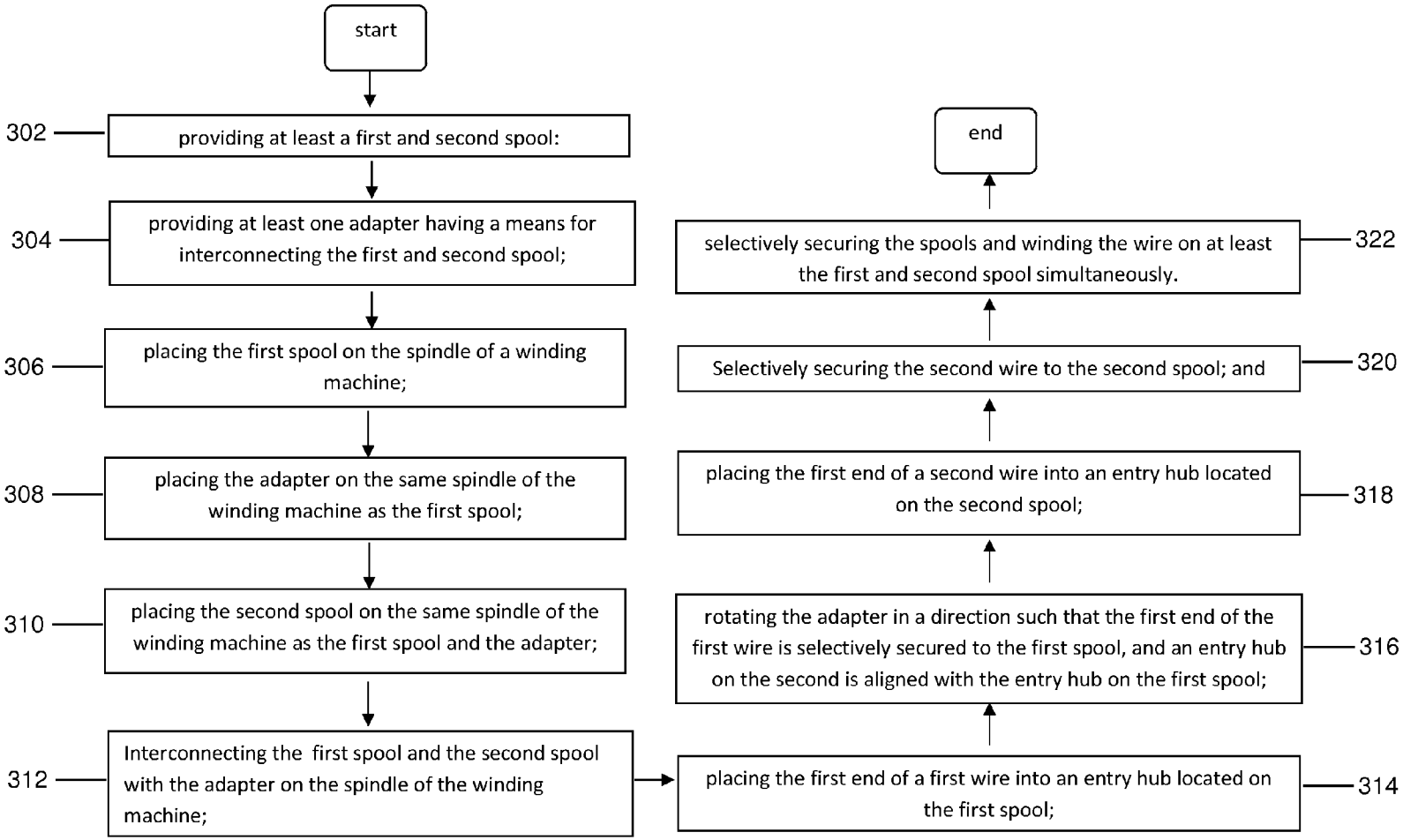
FIG. 8 shows a flowchart of a method for winding multiple spools using the adapter of FIG. 2.

FIG. 8 illustrates a flow chart of an embodiment of method 300 of winding multiple spools using the embodiments of the present invention described herein. While the steps describe the use of multi-spool adapter 100, it should be appreciated that the additional embodiments described herein may be used in a similar manner. In step 302, method 300 includes the step of providing at least a first and second welding wire spool 10*a*, 10*b*. In step 304, method 300 includes the step of providing at least one multi-spool adapter 100 having a means for interconnecting first welding wire spool 10*a* and second welding wire spool 10*b*. In step 306, method 300 includes the step of positioning first welding wire spool 10*a* on mounting shaft 440 of winding machine 400. At this point, an operator of winding machine 400 may elect to secure first welding wire spool 10*a* to a first plate or securing end of winding machine 400, or the operator may choose to secure it during a step prior to feeding the spools simultaneously. In step 308, method 300 includes the step of positioning multi-spool adapter 100 on the same shaft as first welding wire spool 10*a*. In step 310, method 300 includes the step of placing second welding wire spool 10*b* on the same shaft as first welding wire spool 10*a* and multi-spool adapter 100. In step 312, method 300 includes the step of interconnecting first welding wire spool 10*a* and second welding wire spool 10*b* with multi-spool adapter 100 on the mounting shaft 440. In this step, pins 150 are received within curvilinear axial slots 24 of both first welding wire spool 10*a* and second welding wire spool 10*b*. As previously stated, the operator may elect to secure the spools at this time to winding machine 400, or prior to the step of feeding welding wire 200. In step 314, method 300 includes the step of placing the first end of welding wire 200 into entry hub 20 of first welding wire spool 10*a*. In step 316, method 300 includes the step of rotating multi-spool adapter 100 in a direction such that the first end of welding wire 200 is selectively secured to first welding wire spool 10*a*, and entry hub 20 on second welding wire spool 10*b* is aligned with entry hub 20 on first welding wire spool 10*a*. The direction may be clockwise or counterclockwise, depending on the desire of the operator. The offset position of pins 150 on the opposed faces of multi-spool adapter 100, allow for alignment of entry hub 20 on second welding wire spool 10*b*. Once the first rotation is made on multi-spool adapter 100, welding wire 200 is secured on one of the spools, thereby releasably securing that spool in a position ready for winding or spooling. The other attached spool then can be rotated in a direction such that entry hub 20 of both spools may be aligned. In step 318, method 300 includes the step of positioning the first end of another welding wire 200 into entry hub 20 of second welding wire spool 10*b*. In step 320, method 300 includes the step of rotating either second plate 420, additional adapter or second welding wire spool 10*b*, thereby selectively securing welding wire 200 to second welding wire spool 10*b*. In step 322, method 300 includes the step of frictionally securing first plate 410 or securing end, the spools and adapter on mounting shaft 440 such that there is limited or no lateral movement during the winding process, and feeding welding wire 200 onto welding wire spools 10*a*, 10*b* simultaneously.

The invention has been described herein with reference to the preferred embodiment. Modifications and alterations will occur to others upon a reading and understanding of this specification. It is intended to include all such modifications and alternations insofar as they come within the scope of the appended claims or the equivalents thereof.

What is claimed is:

1. An adapter for interconnecting multiple spools comprising:

a body having at least one bore extending through a thickness of said body, a first face opposite a second face, and a perimeter;

wherein said first face includes at least one recess extending at least partially through said thickness and adapted to receive a first positioning means therein;

wherein said second face includes at least one recess extending at least partially through said thickness and adapted to receive a second positioning means therein and positioned axially offset from said at least one recess of said first face; and wherein said perimeter includes at least one depression for providing access to at least a portion of a spool flange.

2. The adapter of claim 1, wherein said first and second positioning means is a pin.

3. The adapter of claim 2, further comprising:

a first pin at least partially received within said at least one recess of said first face; and a second pin at least partially received within said at least one recess of said second face.

4. The adapter of claim 3, wherein said first and second pin are frictionally fitted within said recesses on said first and second face.

5. The adapter of claim 1, wherein said perimeter includes:

a pair of opposed depressions for providing access to at least a portion of a flange on a spool.

6. The adapter of claim 5, wherein said perimeter includes:

a second pair of opposed depressions spaced apart from said first pair of opposed depressions for providing access to at least a portion of a spool flange.

7. The adapter of claim 1, wherein said first face and said second face each include:

a pair of opposed recesses;

further wherein said pair of opposed recesses on said first face are axially offset from said pair of opposed recesses on said second face.

8. The adapter of claim 7 further comprising:

a first pair of pins received within said pair of opposed recesses on said first face, and a second pair of pins received within said pair of opposed recesses on said second face.

9. The adapter of claim 7, wherein said first face and said second face each include:

a second pair of opposed recesses;

wherein said second pair of opposed recesses are spaced apart from said first pair of opposed recesses, and further wherein said recesses on said first face are axially offset from said recesses on said second face.

10. The adapter of claim 9 further comprising:

four pins received within said first and second pair of opposed recesses on said first face, and four pins received within said first and said second pair of opposed recesses on said second face.

11. The adapter of claim 1, wherein at least one of said recesses extends through the thickness of said body.

12. An adapter for interconnecting multiple spools comprising:

a body having opposed side faces and a perimeter;

wherein said body includes at least one bore extending through a thickness of said body, and said perimeter includes at least one depression for providing access to at least a portion of a spool; and wherein each of said opposed side faces includes at least one positioning means protruding therefrom, and said at least one positioning means on one of said opposed side faces is axially offset from said at least one pin on the other opposed side face.

13. The adapter of claim 12, wherein said positioning means on said opposed side faces is a pin.

14. The adapter of claim 12, wherein said perimeter comprises:

a pair of opposed depressions for providing access to at least a portion of a spool flange.

15. The adapter of claim 14 wherein said perimeter further comprises:

a second pair of opposed depressions spaced apart from said first pair of opposed depressions for providing access to at least a portion of a spool flange.

16. The adapter of claim 12, wherein each of said opposed side faces include:

two pair of opposed positioning means protruding therefrom, wherein said two pair of opposed positioning means on one of said opposed side faces are axially offset from said two pair of opposed positioning means on the other opposed side face.

17. The adapter of claim 12, wherein:

said positioning means is integral with each opposed side face.

18. The adapter of claim 12, wherein:

said positioning means protruding from said opposed side faces are secured within recesses extending at least partially through the thickness of said body.

19. The adapter of claim 18, wherein:

at least one of said recesses extends through the thickness of said body.

20. An adapter for interconnecting multiple spools comprising:

a body defining a perimeter, and having a first side face and a second side face beneath said perimeter;

wherein said first side face and said second side face include a plurality of pins protruding therefrom, wherein said plurality of pins on said first side face are axially offset from said plurality of pins on said second side face; and wherein said perimeter includes a means for accessing at least a portion of a spool flange.

21. The adapter of claim 20 wherein:

said means for accessing at least a portion of the flange on a spool is at least one depression.

22. The adapter of claim 20 wherein:

said means for accessing at least a portion of the flange on a spool is a pair of opposed depressions.

23. A method for winding multiple spools on a spooling machine having a winding shaft comprising the steps of:

providing at least a first spool and a second spool, wherein said first and second spool each include a first bore for receiving the winding shaft, a curvilinear slot adapted to receive at least a portion of a pin therein, and a pair of opposed flanges;

providing at least one adapter having a body with at least one bore extending through a thickness of said body, a pair of opposed side faces having at least one pin protruding therefrom, and a perimeter, wherein said at least one pin protruding from one of said opposed side faces is axially offset from said at least one pin protruding from said other side face; and wherein said perimeter includes at least one depression for providing access to at least a portion of one of said opposed flanges;

interconnecting said first spool and said second spool with said adapter, wherein said at least one pin on each of said opposed side faces is received within said slots of said first and second spool;

providing a means for mountably securing said first spool, said second spool, and said adapter on the spooling machine; and winding said first spool and second spool simultaneously.

* * * * *